United States Patent [19]

Gelow et al.

[11] Patent Number: 4,583,245

[45] Date of Patent: Apr. 15, 1986

[54] SPEAKER SYSTEM PROTECTION CIRCUIT

[75] Inventors: William J. Gelow, Placentia; James Murphy, San Rafael, both of Calif.

[73] Assignee: Renkus-Heinz, Inc., Irvine, Calif.

[21] Appl. No.: 620,512

[22] Filed: Jun. 14, 1984

[51] Int. Cl.[4] ..... H04R 29/00

[52] U.S. Cl. ..... 381/59; 381/96; 381/100

[58] Field of Search ..... 330/207 P, 298; 381/55, 381/59, 96, 101, 102, 98, 99, 100

[56] References Cited

U.S. PATENT DOCUMENTS

| | | | |
|---|---|---|---|
| 3,449,518 | 6/1969 | Erath | 381/96 |
| 3,678,202 | 7/1972 | Rose | 381/59 |
| 4,227,048 | 10/1980 | Nagata | 381/101 |
| 4,399,326 | 8/1983 | Bode | 381/101 |

*Primary Examiner*—Forester W. Isen

*Attorney, Agent, or Firm*—Knobbe, Martens, Olson & Bear

[57] ABSTRACT

A circuit and method for protecting speakers and speaker systems from damage due to overload conditions. A crossover circuit splits a broad band input signal into output signals of selected frequency ranges, for driving speakers of corresponding frequency ranges. A sensing circuit monitors speaker driving signals and indicates when an overdriving condition exists on a higher frequency range speaker. A control circuit responds to the overdriving condition by causing the crossover circuit to shift the boundary between the split frequency ranges to route a lower frequency portion of the higher frequency range driving signal from the higher frequency speaker to the lower frequency speaker, while leaving output signal gain substantially unchanged in the selected frequency ranges.

26 Claims, 6 Drawing Figures

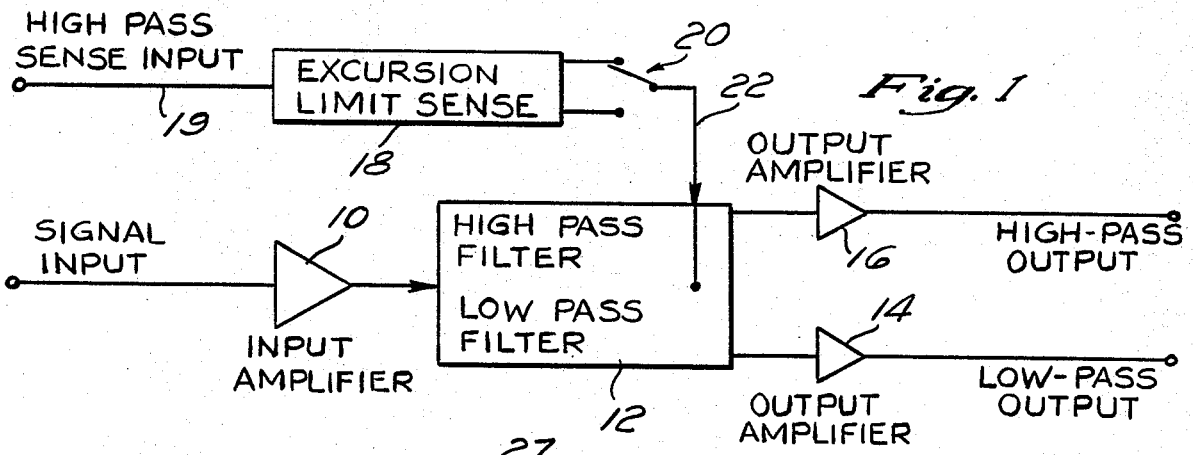
Fig. 1
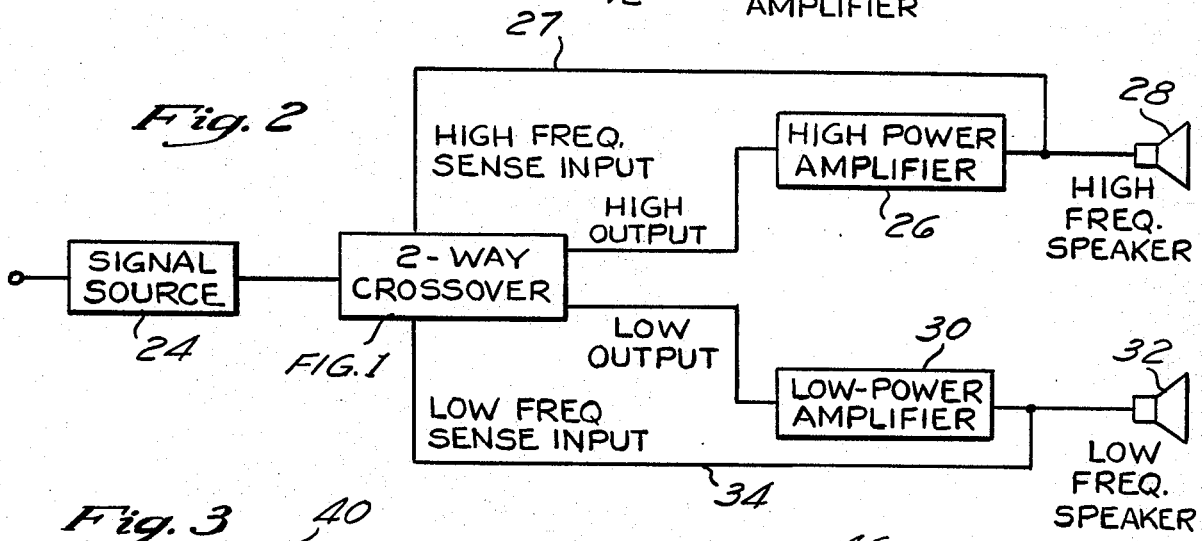
Fig. 2
Fig. 3
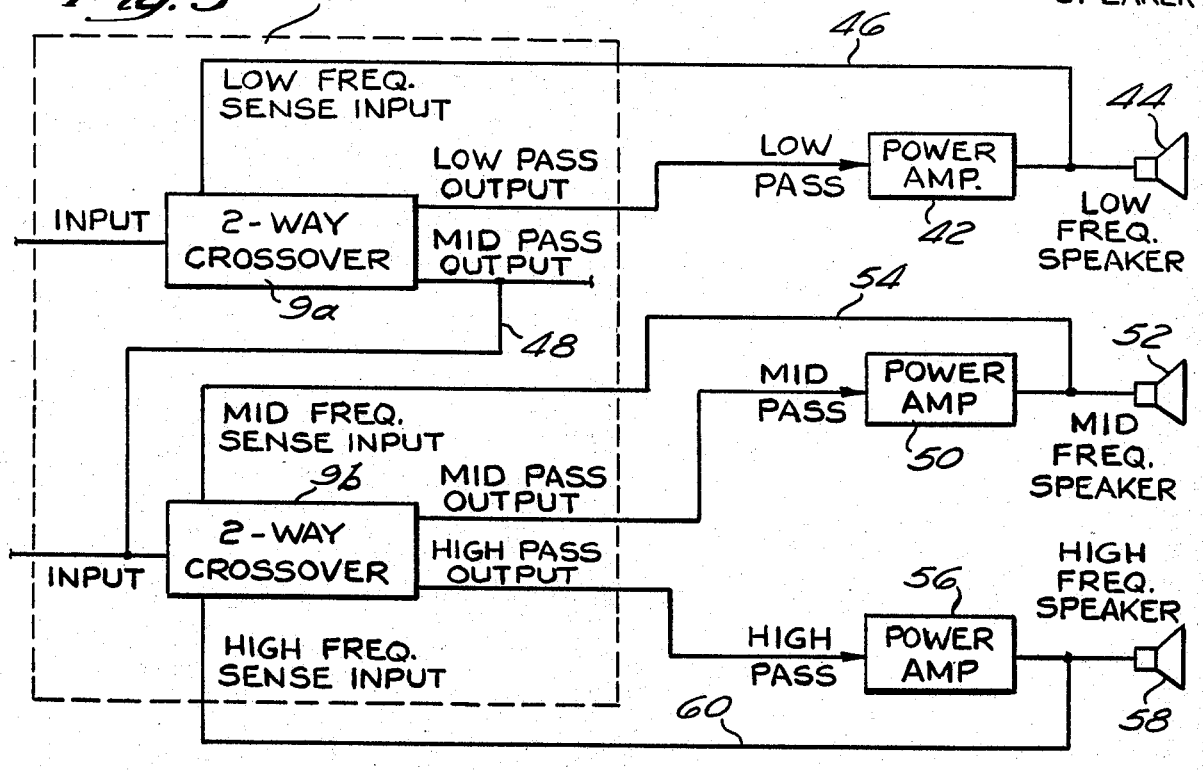

SPEAKER SYSTEM PROTECTION CIRCUIT

BACKGROUND OF THE INVENTION

1. Field of the Invention

The present invention relates to speakers and speaker systems, and in particular to a circuit and method for protecting speaker systems from overload while permitting substantially uniform speaker response.

2. The Prior Art

Sounds which are audible to the human ear lie within a broad frequency band ranging from approximately 20 Hz to about 20 kHz. It is desirable that speaker systems be capable of reproducing sounds at all of these audible frequencies.

Because this audio range covers so many octaves, more than one sound radiator is typically required for the best combination of efficiency, response smoothness, and broad directivity. By dividing the frequency range into parts, and assigning each part a suitable radiator, a superior acoustical result may be provided. Cross-over circuits are commonly used in these multiple speaker systems for accomplishing the frequency range division and for providing selected portions of the frequency range to appropriate speakers.

Cross-over circuits generally involve some type of filter arrangement wherein the audio range input signal is processed to provide several output signals of different frequency ranges, each frequency range being compatible with the reproduction capabilities of a speaker to which the output signal is transmitted. The frequency at which the different frequency ranges intersect is called the cross-over frequency. In prior art systems, this cross-over frequency remains a fixed value under all operating conditions, so that the frequency ranges which are transmitted to the various speakers remain unchanged.

In systems with a single power amplifier, so called "passive" cross-over circuits are connected between the power amplifier and the individual speakers. These passive devices comprise relatively large coils and capacitors which function to divide the audio spectrum into frequency bands at high signal levels.

In more elaborate systems, such as those producing high power output signals, several power amplifiers may be utilized. In these types of systems, "electronic" cross-over circuits split the frequency spectrum at low signal levels prior to transmission to the individual power amplifiers, which are each directly connected to a speaker.

Although the problem of handling sound reproduction across the full audible frequency range is minimized by use of multiple speaker systems, significant limitations in output signal quality are caused by the speakers and speaker systems themselves. Specifically, the output response of an individual speaker typically tends to be somewhat uniform within a given frequency range, which may be quite narrow depending upon the speaker. However, outside of this frequency range the speaker response may deteriorate at a rapid rate.

This deterioration is evidenced by a significant reduction in gain as the output signal frequency becomes more distant from the given frequency range. This problem is experienced more often on the high and low frequency ends of the audible range, and is generally less apparent in the mid-frequency range. This problem is most often overcome through use of equalizers which serve the function of lifting the low and high end of the audible spectrum by compensating for the reduced gain at those frequencies. Thus, with proper use of equalizers, a substantially uniform speaker response over most of the audible frequency range is possible.

Compensation of the reduction in gain by use of equalizers or similar devices tends to overcome the problem of obtaining uniform speaker response, but functions to create other problems which could ultimately result in physical damage to the speaker system itself. Specifically, structural limitations in speaker operation are generally first reached at high and low frequencies. As signal power is increased at high frequencies, rapid vibrations of the diaphragm coupled with the increased power produce excessive heat dissipation in the voice coil. The use of excess power at the high frequency level will ultimately result in the melting of solder connections. Thus, the amount of power which may be added to a system without creating thermal overload is more limited when the system also includes high frequency gain compensation.

At the lower frequencies, the allowable input power is limited by the finite excursion capabilities of the speaker cone or diaphragm. The excursion of this speaker membrane is inversely and linearly proportional to the frequency. For example, if a particular speaker cone moves ±0.1 inch for a given power input at 1,000 Hz, then with the same power input applied at 500 Hz, the cone would move ±0.2 inches, and at 250 Hz it would move ±0.4 inches. Since every speaker is limited at some point in its excursion ability, it becomes apparent that speakers may be destroyed at low frequencies with only a fraction of the power that they handle at the higher frequencies.

Overheating of speakers at high frequencies is often prevented by devices such as current limiters, compressors, fuses and heat sensitive resistors, all of which are commercially available and readily adaptable for high frequency protection. However, these types of devices cannot be used to provide low frequency protection for speakers. For example, a simple fuse connected in series with the speaker can prevent excessive current from damaging the speaker by preventing flow of current beyond a given level. As was pointed out above, speakers can operate at high frequencies at significantly greater power levels than is allowable at the lower frequencies. Thus, limiting the current flow to the speaker at a safe level for low frequency operation significantly and unnecessarily restricts the high frequency operation of the speaker. For these reasons, the other devices described above are also not desirable for use in providing low frequency protection.

Of course, one approach for preventing damage to the high frequency speaker would be to simply set the crossover point at a frequency which is sufficiently high to prevent excessive excursion of the speaker diaphragm. It will be readily appreciated that this approach will simply result in poor performance by limiting the range of frequency reproduction by the speakers, or it will require the further expense of including an additional speaker for reproducing sounds in the frequency range below the crossover point.

Another approach which has been utilized in preventing speaker damage due to excessive diaphragm excursion is to utilize a cone driver or multiple compression driver which allows a high level of diaphragm excursion. In these cases, a low crossover point may be fixed without fear of damage to the speaker at high power levels. However, these types of systems are necessarily much more expensive than a single compression driver, and the cone drivers have a greater amount of distortion than a comparable, single compression driver. Of course, a single compression driver would be susceptible to damage due to excessive excursion, and thus, without more, the single compression driver is limited to use in a low power system which will not produce excessive excursion of the diaphragm at frequencies above the crossover point.

Another method which has been used to provide speaker protection in both low and high frequency overload conditions involves sensing unacceptable power levels and reducing the gain of the speaker in response. Although this method does provide speaker protection, it also does so at the cost of system performance. For example, upon sensing a high frequency thermal operating limiting, a reduction in output signal gain overcomes the problem but also unnecessarily reduces the gain at other, lower frequencies and thus degrades system performance across the full range of frequencies provided to the protected speaker. On the other hand, by reducing the gain to prevent the speaker from exceeding low frequency speaker excursion limits, high frequency operation is again adversely influenced in substantially the same manner as if a fuse were used to limit current flow, as described above. Thus, this protection method also does not provide for uniformity of system response, and it unnecessarily degrades overall system performance.

Still another method for avoiding damage due to excessive power is to incorporate several speakers of the same frequency range in parallel configuration. In this manner, the parallel speakers share the influence of increased power, thus reducing the likelihood of speaker failure and increasing the power handling capabilities as more parallel speakers are included in the system. Of course, this alternative is very costly due to the duplication of systems, and requires a substantial increase in the space required for housing and positioning of the speakers, as well as increasing the difficulty of moving the speakers between performance locations.

Accordingly, what is needed is a circuit and method for protecting speakers and speaker systems from damage due to excessive power levels at low frequencies, while still providing for substantially uniform system operation over a wide frequency range, improved system reliability, and a minimum number of speakers for producing a given audible sound reproduction.

BRIEF SUMMARY OF THE INVENTION

The present invention comprises a novel circuit and method for protecting speakers and speaker systems from damage due to overload at relatively low frequencies, while continuing to provide substantially flat system response over the desired range of frequencies with a minimum number of speakers for the given output. The circuit includes a high pass and low pass filter combination which receives an input signal and splits it into selected frequency ranges which may be utilized in speakers which are connected thereto. The high pass output signal is passed through a power amplifier and then connected to an excursion limit sense circuit, which detects when the power of the output signal will cause the speaker to exceed its excursion limit at the corresponding frequency.

When the above condition occurs, the excursion limit sense circuit modifies the frequency ranges which are passed by the high and low pass filters so that the cross-over frequency between those filters is adjusted upwardly. Thus, the lower portion of the frequency range from the high pass filter is caused to pass, instead, through the low pass filter to the lower frequency speaker.

In other words, the low frequency signal which was exceeding the excursion limit of the higher frequency speaker becomes the high frequency portion of the signal in the lower frequency speaker. Thus, the speaker system can continue operation at the existing power level since the lower frequency speaker can accommodate the shifted signal without threat of damage. Although the cross-over frequency is modified as described above, the gain of the output signal which is transmitted to the speakers is not changed. Therefore, the system response remains substantially uniform while physical damage to the speaker has been prevented.

Because the signal is shifted to the next lower speaker, multiple parallel speakers are not required to handle increased power, and even mid-range speakers become unnecessary since low range speakers can, in most instances, adequately handle the lower frequency portion of signals transferred from the high frequency speakers.

These and other objects and features of the present invention will become more fully apparent from the following description and appended claims taken in conjunction with the accompanying drawings.

BRIEF DESCRIPTION OF THE DRAWINGS

FIG. 1 is a block diagram illustrating the components of a speaker system protection circuit that may be used in accordance with the system and method of the present invention;

FIG. 2 is a block diagram illustrating one preferred embodiment of a speaker system incorporating the speaker system protection circuit of the present invention;

FIG. 3 is a block diagram illustrating another preferred embodiment of a speaker system incorporating the speaker system protection circuit of the present invention;

DETAILED DESCRIPTION OF THE PREFERRED EMBODIMENT

Figure 4:
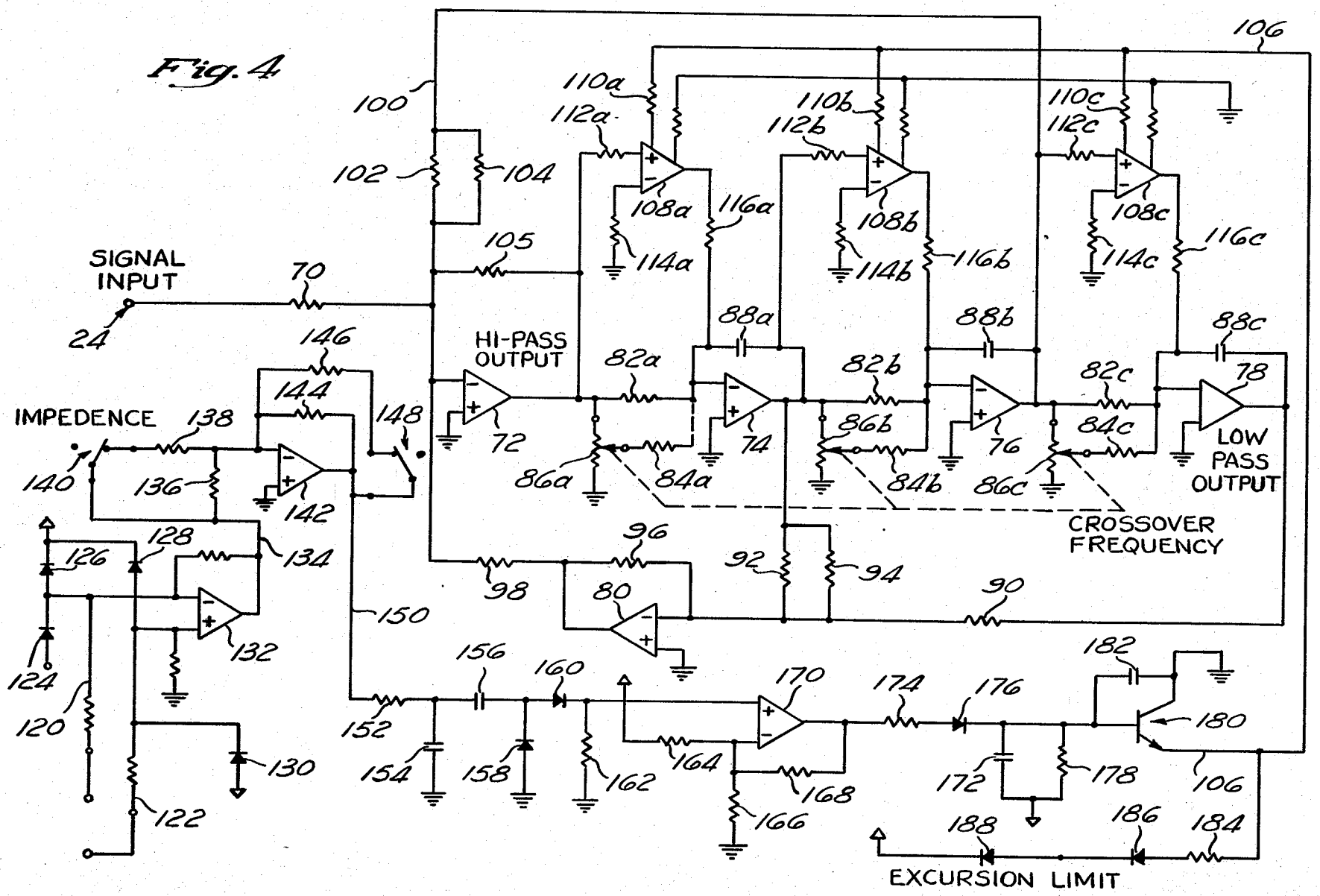
FIG. 4 is a schematic circuit diagram illustrating one preferred embodiment of the speaker system protection circuit of the present invention.

The invention is best understood by reference to the figures wherein like parts are designated with like numerals throughout.

FIG. 1 illustrates one preferred embodiment of the speaker system protection circuit, comprising a two-way crossover protection circuit. Specifically, a broad band audio signal is received by an input amplifier 10, which amplifies it and passes it to a high-pass/low-pass filter section 12, where the signal is divided into a high frequency output and a low frequency output. The low frequency output is transmitted to an output amplifier 14 while the high frequency output is transmitted to output amplifier 16. Amplifiers 14 and 16 comprise signal drivers for providing the necessary drive of the signal to a power amplifier (not shown). The amplified output signals from output amplifiers 14 and 16 are further amplified and processed based upon the particular speaker system circuitry to which they are connected, and they ultimately are used to derive driving signals for operating high and low frequency speakers (not shown) having corresponding frequency ranges. The driving signal also provides an indication as to whether a speaker excursion limit has been reached.

The distance which a speaker diaphragm travels during displacement in reproducing an audio signal is referred to as the excursion distance. Each speaker diaphragm has a maximum excursion distance beyond which physical damage such as tearing or disintegration of the diaphragm will result. This maximum excursion distance is referred to as the "excursion limit." In order to protect the speaker diaphragm from excessive excursion, an excursion limit sense circuit 18 is provided to initiate protective action when the excursion limit is reached. In order to detect when the excursion limit is reached, the sense circuit 18 monitors the speaker driving signal via a high frequency sense input 19.

Excursion limit sense circuit 18 is preset by means of a device such as a switch 20 to identify an excursion limit, based on power level and frequency of the speaker drive signal, with respect to the speaker to which the output signal from amplifier 16 is transmitted. Upon sensing that the output signal has exceeded the excursion limit, sense circuit 18 transmits a signal via line 22 to the filter 12. The signal from line 22 modifies the high-pass and low-pass filter ranges so that the lower portion of the frequency which previously passed through the high-pass filter is caused to pass through the low-pass filter. Since the ranges of both filters are changed by the same amount, the resulting gain remains the same but the cross-over frequency is shifted higher.

When the output signal is again functioning at a lower power level, the excursion limit sense circuit 18 permits the cross-over frequency to shift back to its original value. Thus, physical damage to the speaker system is reliably prevented by shifting the potentially harmful low frequency signal to another speaker. At the same time, the uniformity of the system response over the given frequency range is maintained by not changing the gain of the output signal.

FIG. 2 illustrates one preferred application of the speaker system protection circuit of FIG. 1 in a two-range speaker system. The protection circuit is illustrated at 9. In this case, a signal source 24 provides the broad band audio signal to the speaker protection circuit of FIG. 1, as described above. The high pass output signal from the circuit of FIG. 1 is transmitted to a high frequency power amplifier 26, where it is amplified and then transmitted to a high frequency speaker 28. In addition, the output from amplifier 26 is transmitted via line 20 to the high frequency excursion limit sense circuit 18 of the protection circuit of FIG. 1.

The low pass output signal from the circuit of FIG. 1 is transmitted to a low frequency power amplifier 30 where it is amplified and then passed to a low frequency speaker 32. Optionally, the output signal from amplifier 30 may additionally be transmitted via line 34 to a low frequency sense input of the protection circuit of FIG. 1. The low frequency sense input signal is optionally utilized for purposes such as controlling the gain on the low frequency end of the frequency range passed to low frequency speaker 32. In that application, low frequency signals exceeding the excursion limit are dropped from the frequency range of the output signal transmitted to low frequency speaker 32.

Optionally, the protection circuit of the present invention may be utilized in conjunction with a multiple frequency cross-over system, such as the three speaker system of FIG. 3. It will be noted that the speaker system of FIG. 3 incorporates two protection circuits as described in FIG. 1, and illustrates at *9a* and *9b* protection circuits *9a* and *9b*. Protection circuits *9a* and *9b* are cascaded to form a three-way cross-over speaker protection circuit 40. In this case, the low pass output signal from circuit *9a* is transmitted to a low pass power amplifier 42, where the signal is amplified and transmitted to a low frequency speaker 44. In addition, as discussed above, the output from power amplifier 42 may also be transmitted via line 46 to a low frequency sense input on protection circuit *9a* to provide protection from excess excursion to low frequency speaker 44 in the manner described above.

The mid pass output from protection circuit *9a* is not utilized in connection with the driving of a speaker, however, this output is connected via line 48 to the signal input of protection circuit *9b* in order to permit the appropriate mid range frequency signals to be passed to an appropriate speaker. In circuit *9b*, the mid pass output signal is transmitted to a mid-pass power amplifier 50, and then to a mid-frequency speaker 52. The output from mid pass power amplifier 50 may also be transmitted via line 54 to the mid frequency sense input of circuit *9a*, so that if an excursion limit problem is sensed on the mid frequency speaker 52, the crossover frequency of circuit *9a* is adjusted to shift some frequencies from the mid frequency speaker 52 to the low frequency speaker 44 in the manner described previously.

The high pass output signal from circuit *9b* is transmitted to a high pass power amplifier 56 where it is amplified and then passed to a high frequency speaker 58. Again, the output signal from amplifier 56 may also be transmitted via line 60 to the high frequency sense input of circuit *9b*, where it is processed in an excursion limit sense circuit such as sense circuit 18 which was discussed with reference to FIG. 1. In this case, if excursion limit problems are experienced with respect to high frequency speaker 58, the necessary lower portion of the high frequency range is shifted to the mid frequency range as discussed previously.

In operation, it is noted that the speaker protection circuit configuration illustrated in FIG. 3 functions such that the high frequency sense input of circuit *9b* operates to protect the high frequency speaker 58 by shifting the cross-over frequency in the manner described with respect to FIG. 1. In addition, the mid-frequency speaker 52 and the low frequency speaker 44 are each protected as a result of the mid and low frequency sense input of circuit *9a*. Thus, all three speakers of FIG. 3 are effectively protected against overload conditions, without substantial modification of the system response across the frequency range provided on the signal inputs to the circuit of FIG. 3.

Referring now to FIG. 4, the high-pass/low-pass filter circuit 12 of FIG. 1 may be described in more detail. From a conventional signal source 24 the input signal is transmitted through a unity gain differential amplifier 10, and across a resistor 70 to the input of another differential amplifier 72. Amplifier 72 functions in conjunction with differential amplifiers 74, 76, 78, and 80, with their associated resistor and capacitor networks, to form a third order state variable filter. This filter contains three substantially identical stages comprising, respectively, amplifiers 74, 76, and 78 with their associated resistor/capacitor networks. These are inverting amplifiers which are connected as integrators. Specifically, using the stage associated with amplifier 74 as an example, resistors 82*a* and 84*a* are connected in parallel between the output port of amplifier 72 and the input port of amplifier 74. A variable resistor 86*a* may also be included in series with resistor 84*a*. A capacitor 88*a* is connected in shunt relationship with amplifier 74. Because the stages associated with amplifiers 76 and 78 may be identical to the stage associated with amplifier 74, the resistor and capacitor combinations of those stages are designated with numerals corresponding to those of the first stage.

Because the circuit functions as an integrator, the high frequency portion of the signal from amplifier 72 is shunted away through capacitor 88*a*. Therefore, the high frequency portion of the signal is not amplified. As a result, a signal present on the output of amplifier 78 comprises the filtered, low frequency signal which is to be transmitted to the low frequency speaker. A feedback signal is also transmitted from the output of amplifier 78 through a resistor 90, past a parallel combination of resistors 92 and 94 to the input of an amplifier 80. In addition, the output of amplifier 74 is transmitted through the parallel combination of resistors 92 and 94 to the input of amplifier 80.

Amplifier 80, in combination with the shunt resistor 96 and the series resistor 98 functions in conjunction with the input signal and a feedback signal from amplifier 74 to produce a high pass output signal on the output of amplifier 72. Specifically, amplifier 80 inverts the feed signals from the outputs of amplifiers 74 and 78, which are out of phase due to the inverting nature of the integrators. The output of amplifier 76 is in the correct phase to be directly returned to the input of amplifier 72 since it is the second inverting stage. This high pass output signal is to be utilized by the high frequency speaker in the speaker system. In order to provide a more complete understanding of the performance characteristics of this filter arrangement, the Butterworth transfer function which describes this circuit is provided below:

$$T(s) = \frac{1}{1s^3 + 2s^2 + 2s + 1} \quad (1)$$

where $s = j\omega$

The combination of the resistor and the capacitor networks define the cutoff frequency of the filter. By changing the resistance, the cutoff frequency can be changed. Thus, by adjusting the value of resistors 86*a*–86*c*, the cutoff frequency of each stage in the filter can be changed. In the circuit illustrated, each resistor 82*a*–82*c* has a value of 100K ohms while each resistor 84*a*–84*c* was selected at 11K ohms. Capacitors 88*a*–88*c* each has a value of 0.0033 μf.

The illustrated circuit provides an inverted high-pass output of 18 dB/octave on the output of amplifier 72, while the low-pass output from amplifier 78 is a complimentary 18 dB/octave. The high-pss and low-pass outputs are equal in value at the center or cross-over frequency $F_c$. $F_c$ is defined by the time constant of the three integrators formed by amplifiers 74, 76, and 78. With the values of resistors 84*a*–84*c* the same, and in the simplest case when resistors 86*a*–86*c* are not connected in series with resistors 84*a*–84*c*, the value of $F_c$ is as follows:

$$F_c = \frac{1}{2\pi\sqrt{R82a \times R82b \times R82c \times C88a \times C88b \times C88c}} \quad (2)$$

In the case where all three integrator resistors (82*a*–82*c*) and all three integrator capacitors (88*a*–88*c*) are equal to each other, the above expression is simplified to:

$$F_c = \frac{1}{2\pi \times R82a \times C88a} \quad (3)$$

Of course, when the variable resistors 86*a*–86*c* are included in the circuit, the frequency $F_c$ is determined by substituting into equations of (2) and (3) the values resulting from combining resistors 82*a*–82*c* in parallel with the corresponding series combinations of resistors 84*a*–84*c* and resistors 86*a*–86*c*.

The gain at cross-over frequency $F_c$ depends on the Q of the filter, which is controlled by the feedback from the output of amplifier 72 to its input through resistor 105, feedback from the output of amplifier 74 through resistors 92 and 94, and feedback of the output from amplifier 78 through resistor 90, in combination with the output of amplifier 76 which is transmitted via line 100 through the parallel combination of resistors 102 and 104 to the input of amplifier 72. In one preferred embodiment, the filter arrangement described herein comprises a Butterworth alignment.

The means by which the Butterworth arrangement is achieved is as follows. The transfer function of integrators such as amplifiers 72, 74, 76 and 78 is $-1/s$. Feedback from the four integrators, as described above, directly implements the transfer function of equation (1). Specifically, the output of amplifier 78 is the $S^3$ term, the output of amplifier 76 is the $S^2$ term, the output of amplifier 74 is the $S^1$ term, and the output of amplifier 72 is the $S^0$ or constant term. The values of the feedback resistors associated with each integrator establish the magnitude of the coefficient for each term. If resistors 90, 92, 94, 102, 104 and 105 are all equal, and resistors 96 and 98 are independent but equal to each other, the Butterworth transfer function is realized.

With the value of the resistors and capacitors as indicated above, the filter circuit 12 provides a 10 to 1 tuning range of the filter. Specifically, this embodiment provides a range from 500 Hz to 5,000 Hz. Of course, the total range of the circuit is designed to pass frequencies from 20 Hz to 20,000 Hz. However, the filter is intended to be used for transferring lower frequencies of the high frequency range to the low frequency range in order to reduce excursion distances on the high frequency speaker. Since the low frequency speaker is essentially non-functional at 10 kHz, but does typically respond in the range of 5 kHz, it would be unnecessary to provide a larger tuning range.

In addition, the circuit is designed so that, as the frequency range of the high frequency signal is adjusted, the low frequency signal is also adjusted, thereby modifying the cross-over frequency independent of gain. The tuning range of filter 12 can be increased or decreased, if desired, by adjusting the values of the resistors and capacitors of the integrators comprising amplifiers 74, 76, and 78. The easiest method of accomplishing such a change in the tuning range is to change the capacitors 88a–88c, through use of conventional techniques which are well known to those skilled in the art.

The high pass output from amplifier 72 is transmitted to the high pass output amplifier 16 of FIG. 1, while the low pass output from amplifier 78 is transmitted to the low frequency output amplifier 14 of FIG. 1.

As was discussed previously, the cross-over frequency of the present device is adjusted in response to a determination that a speaker excursion limit has been reached. When such a condition exists, an excursion limit signal is received by filter circuit 12 from the excursion limit sense 18 of FIG. 1. A more detailed description of how this is accomplished is made possible by reference to FIG. 4. Specifically, the excursion limit signal is transmitted via line 106 through resistors 110a, 110b, and 110c to the control current inputs of transconductance amplifiers 108a, 108b, and 108c respectively. Each of these transconductance amplifiers 108a–108c have an output current which is proportional to their differential input voltage, multiplied by the control current through resistors 110a–110c.

Amplifiers 108a–108c and their associated resistance networks are connected to act like voltage controlled resistors shunted across resistors 82a–82c. Each of the amplifiers 108a–108c receives an input voltage from the outputs of one of amplifiers 72, 74, or 76 through one of resistors 112a, 112b, and 112c. This input voltage becomes the differential input voltage, since the other voltage input on each of amplifiers 108a–108c is tied to ground through resistors 114a, 114b, and 114c. The output signal from each of amplifiers 108a–108c is transmitted through resistors 116a, 116b and 116c to the input of the next adjacent amplifier, 74, 76, or 78, respectively.

In one preferred embodiment, resistors 110a–110c have a value of 4.7K ohms; resistors 112a–112d have a value of 150K ohms; resistors 114a–114c have a value of 150K ohms; and resistors 116a–116c have a value of 4.7K ohms. In this condition, when the excursion control voltage is at a level of −5 volts, the voltage across resistors 110a–110c is about 9.4 volts, causing a control current of about 2.0 mA. The effect of this 2.0 mA current is the same as that caused by a 33K ohm resistor, raising the cross-over frequency from 500 Hz to 2,000 Hz.

The excursion limit sense circuit (18 of FIG. 1) may be described in more detail by reference to FIG. 4. Excursion limit sense circuit 18 provides the excursion limit signal to line 106 of of the filter circuit 12. In sense circuit 18, the high-frequency amplifier signal from amplifier 26 of FIG. 2 is applied to line 120, while line 122 provides a signal of opposite polarity. Diodes 124, 126, 128, and 130 provide voltage protection for an input amplifier 132. Amplifier 132 is a differential amplifier with a gain of much less than one. The input signals from lines 120 and 122 are applied to amplifier 132, where the signal is amplified and transmitted onto line 134.

From line 134 the signal passes through resistor 136 which is optionally connected in parallel with resistor 138, dependent upon the status of a switch 140. Switch 140 is manually placed in the open or closed position based upon the impedance of the speaker to which the sense circuit is connected. For example, in one preferred embodiment the switch position is a function of whether the speaker impedance is 16 ohms or 8 ohms. In that preferred embodiment, if the impedance is 8 ohms, switch 140 is placed in the closed position placing resistor 138 in parallel combination with resistor 136. In this illustrated preferred embodiment, resistor 136 has a value of 10K ohms while resistor 138 has a value of 32K ohms. Of course, other resistor values may be used if the speaker impedance values are different.

The signal next passes into a differential amplifier 142 which scales the signal based upon the value of a shunt resistor 144 and, optionally, a resistor 146 which is in parallel configuration with resistor 144. Resistor 146 is connected in series with a switch 148 which is manually positioned in either the open or closed configuration depending on the type of driver which the speaker has. For example, in one preferred embodiment, switch 148 is placed in the open position when the speaker has a 2 inch driver type, and in the closed position (as illustrated) to place resistor 146 in parallel with resistor 144 when the speaker has a 1 inch driver type. In this preferred embodiment, resistor 144 has a value of 10K ohms, while resistor 146 has a value of 22 1 K ohms. Of course, other resistor values may be used in conjunction with speakers having driver types other than those identified above.

From amplifier 142, the signal is transmitted onto a line 150 where it is integrated by the combination of a resistor 152 and a capacitor 154 to yield a signal which approximates the excursion of the high-frequency speaker diaphragm. A capacitor 156 and diodes 158 and 160 function to level shift and peak rectify the signal so that the peak to peak signal appears across a resistor 162.

Resistors 164, 166, and 168 are connected to an amplifier 170 so as to define a peak to peak threshold voltage level for signals on the input of amplifier 170. Thus signals on the input of amplifier 170 will be passed through the amplifier when their peak to peak voltage is above the threshold level. Specifically, resistors 164, 166, and 168 are set to describe a threshold level corresponding to the excursion limit of the high-frequency speaker diaphragm.

One typical way of expressing the excursion limit is in terms of acoustic power, which corresponds to the maximum signal power for speaker excursion displacement limited power rating. The acoustic power may be expressed as follows:

$$P = \frac{\rho c\,(2\pi f)^2\, d^2\, A_D^2}{2A_H}\, 10^{-7} \qquad (4)$$

where:

$\rho_o$=density of air
c=velocity of sound
f=frequency
d=maximum displacement diaphragm
$A_D$=area of diaphragm
$A_H$=area of horn throat When the power is known, those skilled in the art can use conventional means for determining the values of resistors 164, 166 and 168 necessary to describe the appropriate threshold level. When the peak to peak signal across resistor 162 exceeds this threshold level, the output of amplifier 170 rises from its normal level of −14 volts and quickly charges a capacitor 172 through a resistor 174 and a diode 176.

It is noted that capacitor 172 will remain charged so long as the signal across resistor 162 exceeds the preselected threshold value. Once this voltage level drops below the threshold limit, capacitor 172 discharges slowly through resistor 178 so that the resulting shift in the cross-over frequency of the system, which occurred rapidly when the capacitor 172 was charged, may slowly be returned to the normal position. By slowly returning the cross-over frequency, it becomes very difficult to audibly detect any shift in the sound as it is transferred between the high and low frequency speakers, when those speakers are positioned relatively close together.

The voltage level developed across capacitor 172 is buffered by an emitter follower 180 which is connected in shunt with a capacitor 182. The resulting signal comprises the excursion limit signal which is transmitted from the emitter follower 180 onto line 106 which is connected to the transconductance amplifiers 108*a*–108*c* of the filter circuit 12. In addition, a resistor 184 and a diode 186 allow direct excitation of a light emitting diode 188 which may be positioned on a panel of a speaker control system (not shown) so as to provide a visual indication that an excursion limit signal has been generated.

Figure 5:
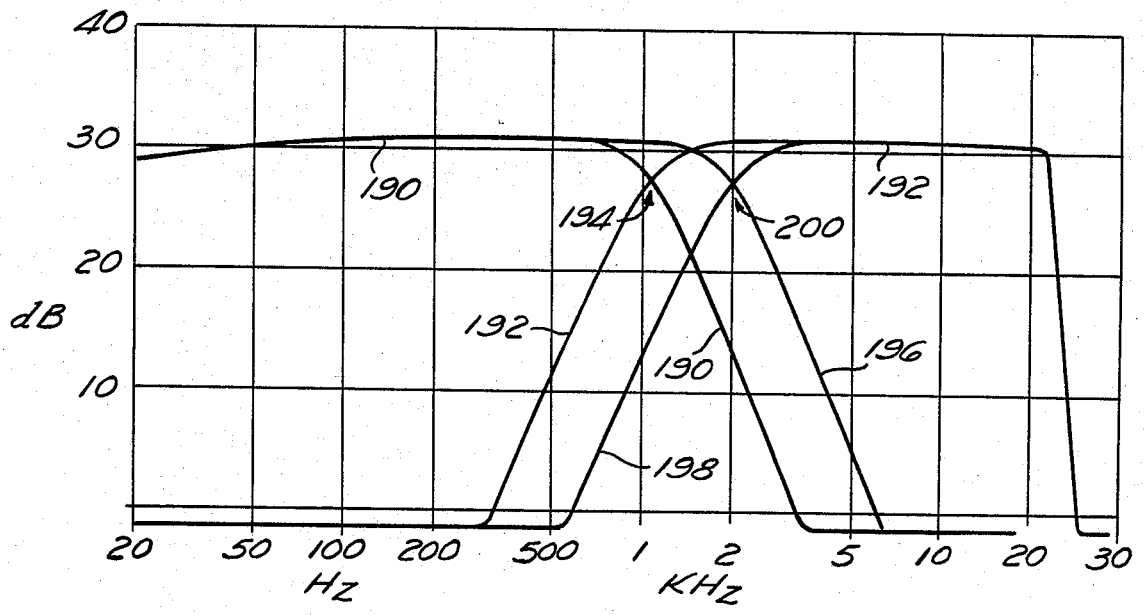
FIG. 5 is a graphical representation of the response of a speaker system, incorporating the present invention, to input signals at selected voltage levels.

Referring to FIG. 5, the shift in cross-over frequency is graphically illustrated for one particular operating condition. Specifically, trace 190 illustrates the gain versus frequency wave form of the output signal from low power amplifier 30 in FIG. 2, when a one volt RMS signal is detected at the high frequency sense input of the two way cross-over 9 of FIG. 2. Trace 192 illustrates the corresponding gain versus frequency plot of the output of low power amplifier 30 of FIG. 2 under these conditions. The cross-over point in this situation is illustrated at 194, and is approximately 3 dB down from the peak gain of the output signals. This cross-over frequency is approximately 1 kHz.

In the same circuit, if the output signal from high power amplifier 26 in FIG. 2 is sensed as being 10 volts RMS on the high frequency sense input, then the resulting gain versus frequency plot for the output of low power amplifier 30 will shift to the trace indicated at 196, while the similar plot of the output of high power amplifier 26 shifts to the trace at 198. The corresponding shift in the cross-over frequency is illustrated at 200. Specifically, the cross-over frequency has shifted to approximately 2 kHz, while the gain continues to remain at approximately 3 dB below the peak gain of the output signals.

Thus, under the conditions described above, the cross-over point illustrated in FIG. 5 has been shifted such that frequencies between 1 and 2 kHz which were initially transmitted to the high frequency speaker 28 of FIG. 2 are subsequently transmitted to the low frequency speaker 32. This shift in cross-over frequency is accomplished strictly by adjustment of the filtering of the system, and without adjustment or other influence to the gain of the output signals. Because the gain is not adjusted, system performance remains substantially uniform with the only change in system operation being that a portion of the sound which previously came from the high frequency speaker is now transmitted from the low frequency speaker.

Figure 6:
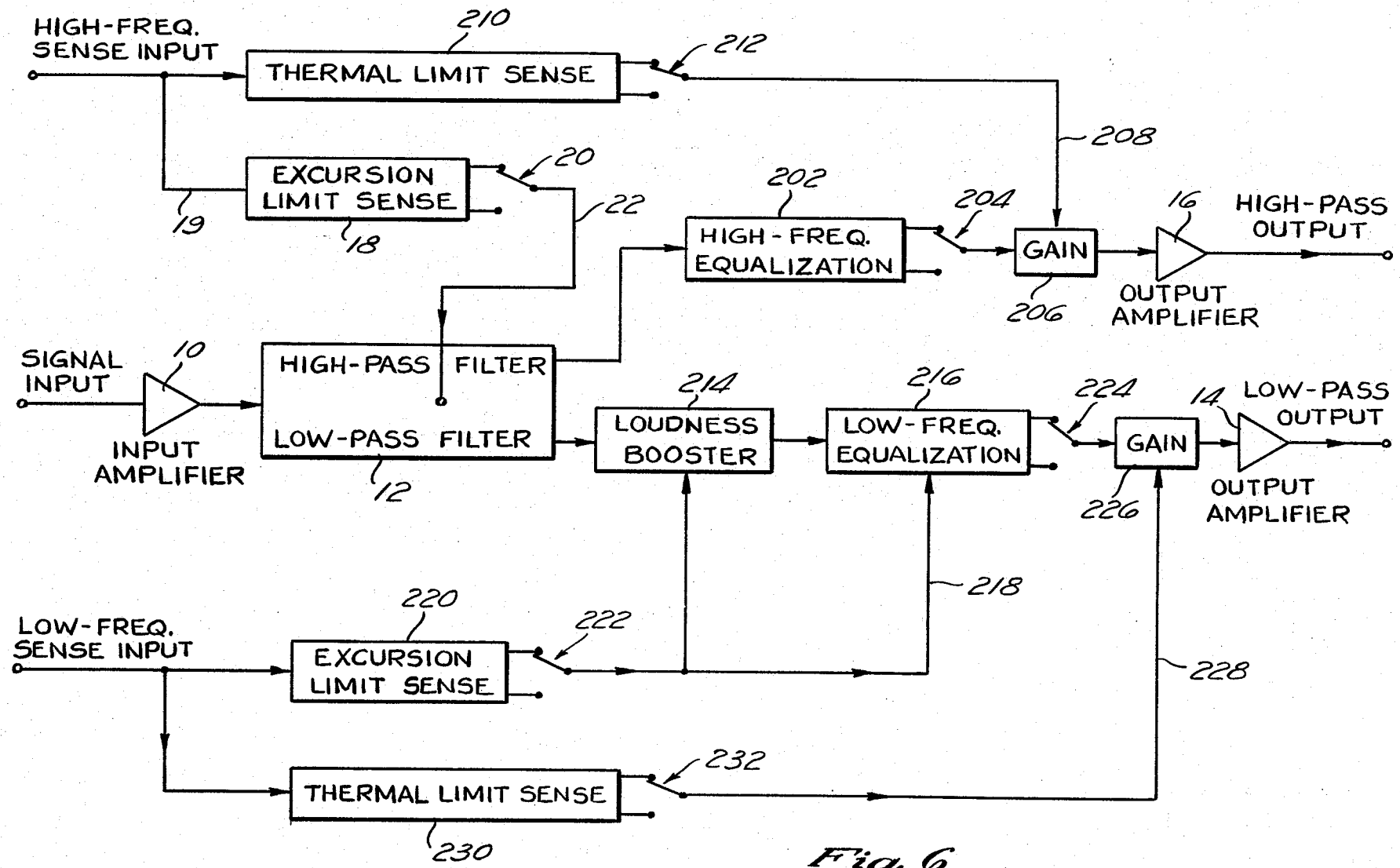
FIG. 6 is a block diagram illustrating another preferred embodiment of a speaker system protection circuit which incorporates the system and method of the present invention.

By reference to FIG. 6 it is possible to see how the speaker protection device of the present invention may be utilized in combination with other speaker protection systems for providing complete protection of the speaker from various overload conditions. It will be noted that the input amplifier 10, the high-pass/low-pass filter 12, the output amplifiers 14 and 16, and the excursion limit sense circuit 18 correspond to those similarly numbered elements of FIG. 1, and have previously been described with reference to that Figure.

In the protection system of FIG. 6, high frequency signals from filter 12 are fed to a high frequency equalization circuit 202 which uses well known, conventional methods to compensate for reduced efficiency of the transducer at high frequency levels in order to provide substantially constant sound pressure levels across selected frequency ranges. Switch 204 is connected to the output of frequency equalizer 202 to select whether frequency equalization is to be utilized.

From switch 204 the high frequency signal is transmitted to a gain control circuit 206. Gain control circuit 206 functions in response to a signal received via line 208 from a thermal limit sense circuit 210. Specifically, thermal limit sense circuit 210 is connected to an output of power amplifier 26 of FIG. 2, via line 27, and functions to detect whether a thermal limit of the speaker has been reached. Thermal limit sense circuit 210 includes a switch 212 for manually selecting the appropriate thermal limit, depending upon the type of speaker which is being used.

When the thermal limit is exceeded, thermal limit sense circuit 210 transmits a signal on line 208, causing a reduction in the gain of the output signal transmitted from gain control circuit 206. The gain of this output signal is reduced in response to signals on line 208 to a level which prevents thermal damage to the interconnected speaker. Systems for detecting thermal limits and for adjusting gain in order to prevent thermal damage to the speakers are well known in the art.

The signal from gain control circuit 206 is next transferred to the output amplifier 16 where it is amplified and transmitted to the high pass output for further use, as previously described.

Referring again to the high-pass/low-pass filter 12, low frequencies from the low pass filter output may be passed onto a loudness boost circuit 214 which functions to increase the signal gain on the low end of the low frequency signal. Devices for doing this are well known in the art. This type of gain compensation is often utilized to increase the volume of low frequency signals during low power conditions so that the human ear may more readily detect these signals.

From the loudness boost circuit 214, the signal is transmitted to a low frequency equalization circuit 216 which functions in response to a signal received via line 218 from an excursion limit sense circuit 220. Excursion limit sense circuit 220 functions in like manner to the excursion limit sense circuit 18, which was described with reference to FIG. 1. In this case, the excursion limit sense circuit 220 is connected to the output of low power amplifier 30 of FIG. 2, via line 34. Thus, this circuit functions to sense low frequency signals which may cause the low frequency speaker to exceed a selected excursion limit. As with the excursion limit sense circuit 18, sense circuit 220 includes a switch 222 for manually selecting the appropriate excursion limit, based upon the type of speaker which is being used.

When excursion limit sense circuit 220 determines that an excursion limit has been exceeded, it produces a signal which is transmitted via line 218 to cause the low frequency equalization circuit 216 to reduce the gain of the low frequency end of the signal received from loudness boost 214. Under normal conditions, when the excursion limit is not exceeded, low frequency equalization circuit 216 functions to increase the gain of the lower frequency portion of the low pass signal, so as to produce a substantially uniform response over the range of the low frequency signal. As with high frequency equalization circuits, low frequency equalization circuits are well known and commonly utilized in the art.

Like the high frequency equalization circuit 202, low frequency equalization circuit 216 includes a switch 224 for selecting whether low frequency equalization is to be applied. From switch 224 the low frequency signal is transmitted to a gain control circuit 226 which functions in response to a signal received via line 228 from a thermal limit sense circuit 230 to reduce the gain of the low frequency signal when sense circuit 230 determines that a thermal limit of the speaker is exceeded. Thermal limit sense circuit 230 includes a switch 232 for manually selecting the appropriate thermal limit based upon the speaker which is being utilized. Gain control circuit 226 and thermal limit sense circuit 230 function in a manner identical to that of the gain control circuit 206 and thermal limit sense circuit 210 with the exception that they operate to control the gain on the low frequency signal which is received through thermal limit sense circuit 230 from the output of low power amplifier 230 of FIG. 2, via line 234. Circuits for accomplishing this function of protecting speakers from thermal damage are well known and commonly utilized in the art.

From gain control circuit 226, the low frequency signal is transmitted to output amplifier 14 where it is amplified and further transmitted to the low pass output for use as previously described.

It will be appreciated that the circuit illustrated in FIG. 6 is but one of many embodiments in which the invention of the present application could be utilized. Such a device as illustrated in FIG. 6 provides complete speaker protection against both thermal damage and excursion damage. However, unlike prior systems, the system of FIG. 6 prevents excursion damage to the high frequency speakers by adjusting the cross-over frequency to pass the potentially damaging portions of the signal from the high frequency speaker to the low frequency speaker, where those portions of the signal do not pose a threat of damage. By this means, speaker protection is provided while sound reproduction quality is not degraded through modification of signal gain.

In summary, not only does the invention described herein comprise a significant improvement over the prior art in providing reliable protection of speakers and speaker systems, but it also overcomes other long existent problems in the art by (1) providing a means for achieving excursion protection independent of gain, thereby providing such protection without substantially influencing system response across the selected frequency range; (2) providing a protection system which permits high quality system performance with use of a minimum number of speakers for a given output; (3) providing a protection system which permits more complete use of the capabilities of a given speaker, so that speaker size and associated enclosure size for providing a given result may be reduced from the size of those devices previously required; and (4) providing a protection system which may be compatibly used with other speaker protection systems for providing full protection from overloads to speakers and speaker systems.

In addition to overcoming these problems, the device and method of this invention provide an inexpensive means for obtaining full protection of the speakers and speaker systems. Because cross-overs are commonly used with speaker systems that utilize more than one speaker, the present invention may be inexpensively incorporated into those systems and utilized in conjunction with other protective schemes already provided for more fully protecting the speaker systems.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Patent is:

1. A speaker protection circuit adapted to avoid damage, due to overload conditions, to a speaker which is driven by a speaker driving signal of a given frequency range the protection circuit comprising:

means for sensing a speaker overload condition; and means, responsive to the sensing means, for altering the frequency range of said speaker driving signal so as to remove the overload condition while leaving gain of the driving signal substantially unchanged within an unaltered portion of the frequency range.

2. A speaker protection circuit as defined in claim 1 wherein said means for altering comprises a cross-over circuit which defines the selected frequency range with respect to a cross-over frequency and processes input signals to provide said speaker driving signal.

3. A speaker protection circuit as defined in claim 2 wherein said cross-over circuit comprises a filter circuit which separates a broad band input signal into a plurality of output signals of various frequency ranges, one of the output signals being within said selected frequency range.

4. A speaker protection circuit as defined in claim 2 wherein the means for altering comprises a tuning circuit electrically connected to the cross-over circuit for tuning the cross-over circuit so as to shift the cross-over frequency and thereby alter the frequency range of the driving signal.

5. A speaker protection circuit as defined in claim 2 wherein the sensing means comprises a detection circuit for identifying when a speaker excursion limit is reached.

6. A speaker system protection circuit for processing an input signal so as to provide substantially uniform speaker response over a selected frequency range while preventing damage to speakers from overload conditions, the protection circuit comprising:

a cross-over circuit for separating the input signal into a plurality of output signals of different frequency ranges;

a detection circuit electrically connected to one of the output signals for detecting overload conditions; and a tuning circuit responsive to the detection circuit for adjusting the cross-over circuit so as to modify the frequency range of at least one of the plurality of output signals, while leaving gain of the output signals substantially unchanged within the unchanged portion of the output signal frequency ranges, thereby removing the overload conditions.

7. A speaker system protection circuit as defined in claim 6, wherein the cross-over circuit comprises filters for passing signals of different frequency ranges to different speakers and wherein a frequency which defines a lower boundary for one selected frequency range and an upper boundary for another selected frequency range is a cross-over frequency between those selected frequency ranges.

8. A speaker system protection circuit as defined in claim 7 wherein the tuning circuit comprises circuit elements defining voltage controlled resistors for modifying the frequency ranges passed by the filters so as to shift the cross-over frequency while leaving gain of the output signals substantially unchanged in the modified frequency ranges.

9. A speaker system protection circuit as defined in claim 6 wherein the detection circuit comprises a sensor for identifying when a speaker excursion limit is reached.

10. A speaker system protection circuit as defined in claim 6 further comprising:

means for sensing when a selected speaker thermal limit is reached; and means responsive to the sensing means for adjusting gain of an output signal to provide speaker operation below the speaker thermal limit.

11. A speaker system protection circuit as defined in claim 6, further comprising means electrically connected to the output of the cross-over circuit for increasing output signal gain at selected frequencies to provide substantially constant sound pressure levels across the selected frequency range.

12. A speaker system protection circuit as defined in claim 6, further comprising:

means for changing gain of at least one of the output signals; and means, responsive to the detection circuit, for controlling the means for changing gain so that gain of at least one of the output signals is reduced when overload conditions are detected.

13. An audio amplification system for driving first and second loudspeakers, comprising:

a circuit for routing a low frequency band to a first speaker, a high frequency band to a second speaker and a mid frequency band, between said high and low frequency bands, selectively to said a first or second speaker; and a circuit for sensing an overdriving condition of said a second speaker, and for controlling said routing circuit to rout said mid frequency band to said a first speaker in response to such overdriving condition while leaving gain of signals in the bands substantially unchanged.

14. A method of protecting speakers from damage due to overload conditions comprising the steps of:

providing a speaker driving signal which is within a selected frequency range;

sensing a speaker overload condition; and changing the frequency range of the driving signal when a speaker overload condition is sensed, so as to remove the overload condition while leaving gain of the driving signal substantially unchanged within an unchanged portion of the frequency range.

15. A method of protecting speakers as defined in claim 14, wherein the step of providing a driving signal comprises separating a broad band input signal into a plurality of output signals of various frequency ranges, one of the output signals being within the selected frequency range so as to provide the driving signal.

16. A method of protecting speakers as defined in claim 15, wherein a boundary between frequency ranges of selected output signals is defined by a cross-over frequency, and wherein the step of changing the frequency range of the driving signal comprises shifting the crossover frequency between the driving signal frequency range and another frequency range so that a portion of the driving signal frequency range is shifted into the other frequency range.

17. A method of protecting speakers as defined in claim 14, wherein the step of sensing a speaker overload condition comprises the step of sensing when a speaker excursion limit is reached.

18. A method of protecting speakers as defined in claim 17, wherein the step of changing the frequency range of the driving signal comprises raising a lower boundary of the driving signal frequency range to remove a lower frequency portion of the driving signal from the unchanged portion of the driving signal frequency range.

19. A method of protecting speakers as defined in claim 18, further comprising the steps of:

increasing an upper frequency range level of a second driving signal to include the range of the removed low frequency portion of the driving signal; and transferring said removed lower frequency portion to the second driving signal.

20. A method of protecting speakers as defined in claim 14, further comprising the step of changing the frequency range of the driving signal back to its original range in the absence of a sensed overload condition.

21. A method of protecting speakers from overload conditions while providing substantially uniform speaker response over a selected frequency range, the method comprising the steps of:

separating an input signal into a plurality of output signals of different frequency ranges for driving selected speakers;

detecting a speaker overload condition; and modifying the frequency range of at least one of the plurality of output signals, while leaving gain of the output signals substantially unchanged within the unchanged portions of the output signal frequency ranges, thereby removing the overload condition.

22. A method of protecting speakers as defined in claim 21, further comprising the step of passing output signals of different frequency ranges to different speakers, wherein a frequency defining a lower boundary for one selected output signal frequency range and an upper boundary for another selected output signal frequency range comprises a cross-over frequency between those selected frequency ranges.

23. A method of protecting speakers as defined in claim 22, wherein the step of sensing a speaker overload condition comprises sensing when a speaker excursion limit is reached in the speaker receiving the higher of the two selected output signal frequency ranges, and wherein the step of modifying the frequency range comprises increasing the frequency of the cross-over frequency so as to shift a lower portion of the higher selected output signal frequency range to the lower selected output signal frequency range.

24. A method of protecting speakers as defined in claim 21, further comprising the steps of:

sensing when a selected speaker thermal limit is reached; and adjusting gain of an output signal to provide speaker operation below the thermal limit.

25. A method of protecting speakers as defined in claim 21, further comprising the steps of increasing output signal gain at selected frequencies to provide a substantially constant sound pressure level gain across the selected frequency ranges.

26. A method of driving first and second speakers in an audio system, comprising the steps of:

routing a low frequency band to the first speaker;

routing a high frequency band to the second speaker;

routing a mid frequency band, having frequencies between the high and low frequency bands, selectively to one of the first and second speakers;

sensing an overdriving condition of the second speaker; and routing the mid frequency band to the first speaker in response to the overdriving condition, while leaving gain of signals in the bands substantially unchanged.

* * * * *